US011721274B1

(12) United States Patent
Gao et al.

(10) Patent No.: US 11,721,274 B1
(45) Date of Patent: Aug. 8, 2023

(54) DISPLAY DEVICE WITH DISPLAY COMENSATION UNIT AND DISPLAY METHOD THEREOF

(71) Applicant: Shenzhen China Star Optoelectronics Semiconductor Display Technology Co., Ltd., Guangdong (CN)

(72) Inventors: Guoqing Gao, Guangdong (CN); Yunhai Bai, Guangdong (CN); Xinying Luo, Guangdong (CN); Jinao Chen, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/772,630

(22) PCT Filed: Mar. 28, 2022

(86) PCT No.: PCT/CN2022/083240

§ 371 (c)(1),
(2) Date: Apr. 28, 2022

(30) Foreign Application Priority Data

Mar. 18, 2022 (CN) ..... 202210271129.0

(51) Int. Cl.
*G09G 3/20* (2006.01)

(52) U.S. Cl.
CPC ... *G09G 3/2096* (2013.01); *G09G 2310/0291* (2013.01); *G09G 2310/08* (2013.01); *G09G 2340/14* (2013.01)

(58) Field of Classification Search
CPC ..... G09G 3/2096
See application file for complete search history.

(56) References Cited

U.S. PATENT DOCUMENTS

| | | | | |
|---|---|---|---|---|
| 2001/0050678 | A1 | 12/2001 | Nishikubo et al. | |
| 2009/0027364 | A1* | 1/2009 | Kwan | G09G 3/20 345/55 |
| 2013/0106883 | A1* | 5/2013 | Han | G06F 12/0223 345/545 |
| 2021/0375207 | A1 | 12/2021 | Chen et al. | |

FOREIGN PATENT DOCUMENTS

| | | | |
|---|---|---|---|
| CN | 101339733 | | 1/2009 |
| CN | 108492766 | | 9/2018 |
| CN | 113760217 | | 12/2021 |
| JP | 2003195833 | A | 7/2003 |
| JP | 2017204837 | | 11/2017 |
| TW | 201604854 | A | 2/2016 |

* cited by examiner

*Primary Examiner* — Gustavo Polo
(74) *Attorney, Agent, or Firm* — Mark M. Friedman

(57) ABSTRACT

A display device and a display method thereof are provided. An image compensation unit is utilized to analyze a first image signal and a second panel data to calculate a difference value between a row number of first virtual rows included in the first image signal and a row number of second virtual rows included in the second panel data. Further, the first image signal is compensated to obtain a third display signal to display on the display panel, which can improve a display abnormality problem that occurs when the display panel is matched with an image input module from different manufacturers.

20 Claims, 5 Drawing Sheets

DISPLAY DEVICE WITH DISPLAY COMENSATION UNIT AND DISPLAY METHOD THEREOF

FIELD OF INVENTION

The present application relates to a field of display technology, and in particular, to a display device and a display method thereof.

BACKGROUND OF INVENTION

When a display device adopts a display screen and an image input module from different manufacturers, it is necessary to insert virtual rows of different numbers of rows before a first row of data to ensure that the display device can display normally. However, there are differences in the designs from different manufacturers, and there are differences in the virtual rows to be inserted. If the number of virtual rows inserted is incorrect, it is easy to cause abnormal display problems.

Technical Problem

Embodiments of the present application provide a display device and a display method thereof to improve the problem of abnormal display caused by an incorrect number of inserted virtual rows.

SUMMARY OF INVENTION

Embodiments of the present application provide a display device. The display device includes a display panel, an image input module, a memory, and a display compensation unit.

The image input module is configured to provide a first image signal, and the memory is configured to store the second panel data. The display compensation unit includes a processing chip electrically connected to the display panel, the image input module, and the memory, wherein the processing chip is configured to receive the first image signal to obtain a first row number of first virtual rows, configured to receive the second panel data to obtain a second row number of second virtual rows of the display panel, and configured to compensate the first image signal according to a difference between the second row number and the first row number to generate a third display signal, and wherein the third display signal is received by the display panel to display.

Optionally, in some embodiments of the present application, the processing chip is further configured to receive the first image signal to obtain a first virtual row data corresponding to the first virtual rows and configured to according to insert or delete rows of the first virtual row data of the first image signal according to the difference value between the second row number and the first row number to generate the third display signal, wherein a number of the rows of the first virtual row data to be inserted or deleted is the difference value.

Optionally, in some embodiments of the present application, the processing chip is configured to receive the second panel data to obtain an initial row acting on a display area of the display panel and obtain the second row number of the second virtual rows according to the initial row.

Optionally, in some embodiments of the present application, the display compensation unit further includes a readback module. The readback module is configured to read the second panel data in the memory and transmit the second panel data to the processing chip.

Optionally, in some embodiments of the present application, the display compensation unit further includes a storage module. The storage module is configured to store the first image signal output by the image input module and transmit the first image signal to the processing chip.

Optionally, in some embodiments of the present application, the display compensation unit further includes an image acquisition module. The image acquisition module is configured to receive the first image signal output by the image input module and transmit the first image signal to the storage module.

Optionally, in some embodiments of the present application, the display compensation unit further includes an image transmission module. The image transmission module is configured to receive the third display signal from the processing chip and to output the third display signal to the display panel.

Optionally, in some embodiments of the present application, the image input module includes a system-on-chip and a timing controller electrically connected to each other. Wherein the display compensation unit is electrically connected between the system-on-chip and the timing controller, or the timing controller is electrically connected between the system-on-chip and the display compensation unit.

Optionally, in some embodiments of the present application, the system-on-chip includes a central processing unit and a graphics processing unit, the graphics processing unit is configured to convert an output signal of the central processing unit into frames of the first image signal and output the frames of the first image signal to the display compensation unit and the memory.

Optionally, in some embodiments of the present application, the display device further includes a motherboard and a control board, wherein the system-on-chip is disposed on the motherboard, and the timing controller is disposed on the control board.

Optionally, in some embodiments of the present application, the memory includes flash memory.

Optionally, in some embodiments of the present application, the display device further includes a horizontal circuit board, wherein the memory is disposed on the horizontal circuit board.

Optionally, in some embodiments of the present application, the storage module includes a latch.

Optionally, in some embodiments of the present application, the image transmission module includes a data buffer.

Embodiments of the present application further provide a display method of a display device, including following steps:

receiving a first image signal to obtain a first row number of first virtual rows;

receiving a second panel data to obtain a second row number of second virtual rows of a display panel; and compensating the first image signal according to a difference value between the second row number and the first row number to generate a third display signal and displaying on the display panel to display according to the third display signal.

In some embodiments of the present application, the step of receiving the first image signal to obtain the first row number of the first virtual rows further includes: receiving the first image signal to obtain first virtual row data corresponding to the first virtual rows.

The step of compensating the first image signal according to the difference value between the second row number and the first row number to generate the third display signal includes:

inserting or deleting rows in the first virtual row data of the first image signal according to the difference value between the second row number and the first row number to generate the third display signal, wherein a number of the rows of the first virtual row data to be inserted or deleted is the difference value.

Optionally, in some embodiments of the present application, before the step of inserting or deleting the rows of the first virtual row data of the first image signal according to the difference value between the second row number and the first row number to generate the third display signal, the method further includes:

comparing the second row number with the first row number.

Optionally, in some embodiments of the present application, the step of inserting or deleting the rows in the first virtual row data of the first image signal according to the difference value between the second row number and the first row number to generate the third display signal further includes:

determining whether the difference value between the second row number and the first row number is greater than zero.

Optionally, in some embodiments of the present application, the difference value between the second row number and the first row number is greater than zero, and the rows of the first virtual row data are inserted to generate the third display signal, wherein a number of the rows of the first virtual row data to be inserted is the difference value.

Optionally, in some embodiments of the present application, the difference value between the second row number and the first row number is less than zero, and the rows of the first virtual row data are deleted to generate the third display signal, wherein a number of the rows of the first virtual row data to be deleted is the difference value.

Advantages

Compared with prior art, embodiments of the present application provide a display device and a display method thereof. The display device includes a display panel, an image input module, a memory, and a display compensation unit. An image compensation unit is utilized to analyze a first image signal input by the image input module and a second panel data stored in the memory to calculate a difference between a row number of first virtual rows included in the first image signal and a row number of second virtual rows included in the second panel data. Further, the first image signal is compensated to obtain a third display signal, and the third display signal is transmitted to the display panel for display, which can improve a display abnormality problem when the display panel is matched with an image input module from different manufacturers.

DETAILED DESCRIPTION OF PREFERRED EMBODIMENTS

In order to make the objectives, technical solutions, and effects of the present application clearer, the present application will be described in detail with reference to the drawings and embodiments. The embodiments described herein are only used to explain the present application, but not to limit the present application.

Figure 1:
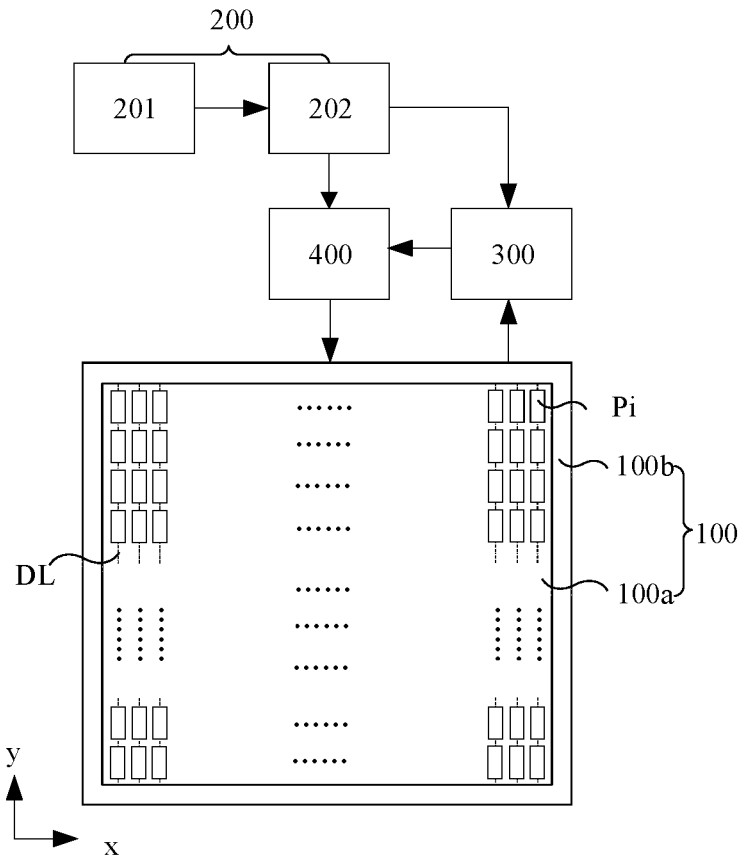
FIG. 1 is a schematic structural diagram of a display device provided by an embodiment of the present application.

Specifically, FIG. 1 is a schematic structural diagram of a display device provided by an embodiment of the present application. The present application provides a display device.

The display device includes a display panel 100, an image input module 200, a memory 300, and a display compensation unit 400.

The display panel 100 includes a display area 100*a* and a non-display area 100*b*. The display panel includes an array substrate and a plurality of pixels. The plurality of pixels are arranged on the array substrate and in the display area 100*a*, and each of the pixels includes a plurality of sub-pixels Pi. The array substrate includes a plurality of pixel driving circuits, a plurality of scan lines, and a plurality of data lines DL. Each of the pixel driving circuits is electrically connected to at least one of the sub-pixels, at least one of the data lines DL, and at least one of the scan lines. The plurality of pixel driving circuits controls the plurality of sub-pixels Pi to emit light according to the scan signal transmitted by the corresponding scan line and the data signal transmitted by the corresponding data line DL to realize the display function of the display panel in the display area 100*a*.

Optionally, the plurality of data lines DL are arranged along the first direction X and extend along the second direction Y, and the plurality of data lines DL transmit a plurality of data signals. The plurality of scan lines are arranged along the second direction Y and extend along the first direction X, and the plurality of scan lines transmit a plurality of scan signals. The first direction x intersects the second direction Y.

Optionally, the emission colors of the plurality of sub-pixels Pi are not limited to red, blue, green, yellow, white, or the like. The structure of the pixel driving circuit is not limited to 2T1C, 5T2C, 7T1C, or other forms. Wherein, T represents a transistor, and C represents a capacitor.

Optionally, the display panel includes a self-luminous display panel, and the display panel includes a light-emitting element forming the sub-pixels. The light-emitting element may be an organic light-emitting diode, a sub-millimeter light-emitting diode, a miniature light-emitting diode, or the like. Optionally, the light-emitting layer of the light-emitting element includes quantum dot material.

Optionally, the display panel includes a passive light-emitting display panel, and the display panel includes a color filter substrate, liquid crystal molecules, pixel electrodes, a common electrode, an alignment layer, and the like. The liquid crystal molecules are provided between the array substrate and the color filter substrate. The sub-pixel includes the pixel electrode, the common electrode, and liquid crystal molecules provided between the pixel electrode and the common electrode. Optionally, the pixel electrode is not limited to 4 domains, 8 domains, or other structural forms. Optionally, the color filter unit may be located on the side of the array substrate or on the side of the color filter substrate. Optionally, the color filter unit includes a fluorescent material, a quantum dot material, or the like.

Optionally, the display panel further includes a polarizer, a touch electrode, a sensing element, and the like. Optionally, the sensing element includes a camera, a fingerprint sensor, a distance sensor, and the like. Optionally, the sensing element may be located in the display area 100*a* or in the non-display area 100*b*.

The image input module 200 provides a first image signal. Optionally, the image input module 200 includes a system-on-chip 201 and a timing controller 202 that are electrically connected. Optionally, the system-on-chip 201 includes a central processing unit and a graphics processing unit. The graphics processing unit is configured to convert an output signal of the central processing unit into multiple frames of the first image signal and output the multiple frames of the first image signal to the display compensation unit 400 and the memory 300 so that the first image signal is compensated by the display compensation unit 400 and the memory 300 to obtain a third display signal for the display panel 100 to display.

Optionally, the display compensation unit 400 is electrically connected between the system-on-chip 201 and the timing controller 202, or the timing controller 202 is electrically connected between the system-on-chip 201 and the display compensation unit 400, as shown in FIG. 1.

Specifically, in a situation where the timing controller 202 is electrically connected between the system-on-chip 201 and the display compensation unit 400, after the graphics processing unit converts the output signal of the central processing unit into multiple frames of the first image signal, it outputs the multiple frames of the first image signal to the timing controller 202. The timing controller 202 transmits the received multiple frames of the first image signal to the display compensation unit 400 and the memory 300 respectively so that the driving module generates a driving signal for driving the display panel 100 to display according to the third display signal obtained after being compensated by the memory 300 and the display compensation unit 400. In a situation where the display compensation unit 400 is electrically connected between the system-on-chip 201 and the timing controller 202, after the graphics processing unit converts the output signal of the central processing unit into multiple frames of the first image signal, it outputs the multiple frames of the first image signal to the display compensation unit 400 and the timing controller 202. The timing controller 202 transmits the received multiple frames of the first image signal to the memory 300 so that the driving module generates a driving signal for driving the display panel 100 to display according to the third display signal obtained after being compensated by the memory 300 and the display compensation unit 400. Wherein, the driving module includes a source driving module and a gate driving module. The source driving module is electrically connected to a plurality of the data lines DL, and the gate driving module is electrically connected to a plurality of the scanning lines.

The display device further includes a motherboard. Wherein, the image input module 200 is disposed on the motherboard, and the image input module can convert the P2P signal into a mini low voltage differential signal (mini-LVDS) for output.

Optionally, the display device further includes a control board. Wherein, the system-on-chip 201 is disposed on the motherboard, and the timing controller 202 is disposed on the control board. The system-on-chip 201 communicates with the timing controller 202 through the V-by-One or VBO protocol, and the timing controller 202 converts the received signal into a mini-LVDS format for output.

Optionally, the image input module 200 has optical adjustment functions such as white balance, overvoltage driving, and Demura (compensating for uneven display on the panel).

The memory 300 is used for storing the second panel data. Optionally, the second panel data includes initialization parameters of the timing controller 202, a display look-up table of the overvoltage driving technology, optical compensation data for compensating for uneven display on the panel, Auto Pgamma data, or other optical data. The second panel data stored in the memory 300 can be used to analyze the initial row of each frame of image signal acting on the display area 100*a* of the display panel 100, and the rows before the initial row are virtual rows. Wherein, the initial row corresponds to a first row displayed on the display panel 100, and the virtual rows refer to image data that does not participate in the image display.

Optionally, the memory 300 is a flash memory (XB-FLash).

The display device further includes a horizontal circuit board. Wherein, the memory 300 is disposed on the horizontal circuit board, the motherboard and the horizontal circuit board can be electrically connected through a flexible flat cable, and the image input module 200 and the memory 300 can communicate through a P2P protocol.

The display compensation unit 400 is electrically connected to the display panel 100, the image input module 200, and the memory 300. The display compensation unit 400 is configured to receive and analyze the first image signal and the second panel data to determine the number of first virtual rows to be inserted in the first image signal, and insert the first virtual rows corresponding to the number of rows into the first image signal to obtain a compensated third display signal so that the display panel 100 can perform display according to the third display signal.

Figure 2A:
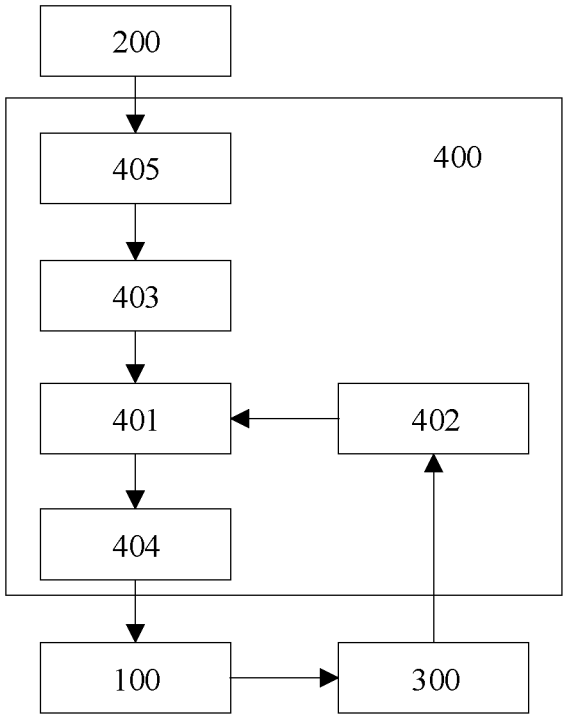
FIG. 2A to FIG. 2B are schematic structural diagrams of a display compensation unit provided by an embodiment of the present application.
Figure 2B:
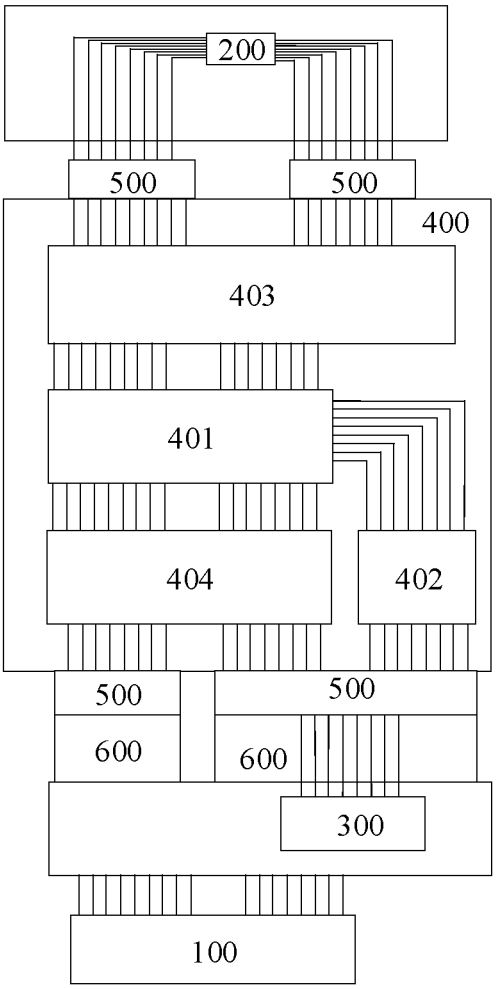

FIG. 2A to FIG. 2B are schematic structural diagrams of a display compensation unit provided by an embodiment of the present application. The display compensation unit 400 includes a processing chip 401. The processing chip 401 is configured to receive and analyze the first image signal and the second panel data to obtain first row number information of the first virtual row included in the first image signal according to the first image signal, configured to obtain second row number information of the second virtual row positioned before the initial row according to the second panel data, and configured to compensate the first image signal according to the difference value between the first row number and the second row number to obtain a third display signal so that the display panel 100 can perform display according to the third display signal.

It can be understood that the first image signal may include a plurality of the first virtual rows.

The processing chip 401 can also be configured to obtain first virtual row data corresponding to the plurality of first virtual rows according to the first image signal to insert or delete a plurality of rows in the first virtual row data of the first image signal according to a difference value between the second row number and the first row number, where the number of rows of the first virtual row data to be inserted or deleted is the difference value.

Specifically, if the difference value between the second row number and the first row number is greater than zero, then the first virtual rows are inserted in the first image signal, where a number of rows of the first virtual row inserted are the difference value between the second row number and the first row number. That is, the first virtual row data is inserted into the first virtual row data to generate the third display signal, wherein the row number of the inserted first virtual row data is the difference between the second row number and the first row number. The first virtual row data corresponding to the inserted first virtual row may be the same as the first virtual row data corresponding to a first virtual row among the plurality of first virtual rows included in the first image signal. Optionally, the data of the multiple first virtual rows corresponding to the multiple first virtual rows may all be the same.

If the difference value between the second row number and the first row number is less than zero, delete the first virtual rows in the first image signal, where the number of the rows of the first virtual rows to be deleted is the difference value between the second row number and the first row number. That is, the first virtual row data is deleted from the first virtual row data to generate the third display signal, where the number of rows to be deleted is the difference value between the second row and the first row.

The display compensation unit 400 further includes a readback module 402. The readback module 402 is used for reading the second panel data in the memory 300 and transmit the second panel data to the processing chip 401.

Optionally, the display compensation unit 400 further includes a storage module 403. The storage module 403 is configured to store the first image signal output by the image input module 200 and transmit the first image signal to the processing chip 401. Optionally, after the storage module 403 transmits one frame of the first image signal to the processing chip 401, the storage module 403 temporarily stores the next frame of the first image signal. Optionally, the storage module 403 is a latch.

Optionally, the display compensation unit 400 further includes an image transmission module 404. The image transmission module 404 receives the third display signal output by the processing chip 401 to output the third display signal to the display panel 100 so that the display panel 100 displays according to the third display signal. Optionally, the image transmission module 404 is a data buffer.

Optionally, the display compensation unit 400 further includes an image acquisition module 405. The image acquisition module 405 receives the first image signal output by the image input module 200, and transmits the first image signal to the storage module 403, as shown in FIG. 2A.

Optionally, the display compensation unit 400 may also be integrated into a source driving module. The image input module 200 and the display compensation unit 400 can be electrically connected through the connector 500. The memory 300 is disposed on the horizontal circuit board, and the memory 300 and the display compensation device 400 are electrically connected through the connector 500 and the flexible circuit board 600.

Figure 3:
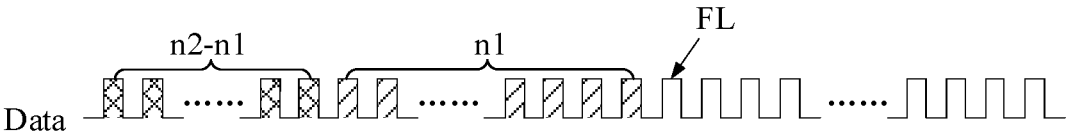
FIG. 3 is a timing diagram of a third display signal provided by an embodiment of the present application.

FIG. 3 is a timing diagram of a third display signal provided by an embodiment of the present application, where FL represents an initial row. Please refer to FIG. 2A to FIG. 2B and FIG. 3, when the display panel 100 of the display device is powered on, the readback module 402 in the display compensation unit 400 reads back the second panel data in the memory 300 and transmits the second panel data to the processing chip 401. The processing chip 401 analyzes the second panel data to obtain a second number n2 of the second virtual rows. The processing chip 401 transmits an instruction to the storage module 403, receives the first image signal stored in the storage module 403, and analyzes the first image signal to obtain the first row number n1 of the plurality of first virtual rows in the first image signal. The first image signal is compensated according to the difference value between the first row number n1 and the second row number n2 to obtain a third display signal Data for the display panel to display. Specifically, it is assumed that the processing chip 401 analyzes the second panel data, and obtains that the second row number n2 of the plurality of second virtual rows is 100. Subsequently, the processing chip 401 receives a frame of the first image signal transmitted by the storage module 403, analyzes the first image signal, and obtains that the first row number n1 of the plurality of first virtual rows in the first image signal is 90. Then the processing chip 401 will add 10 rows of the first virtual rows to the first image signal. That is, 10 rows of first virtual row data are inserted into 90 rows of first virtual row data to obtain a third display signal Data including 100 rows of the first virtual rows. Therefore, when the display panel 100 is matched with an image input module 200 from different manufacturers, the problem of abnormal display does not occur.

Figure 4A:
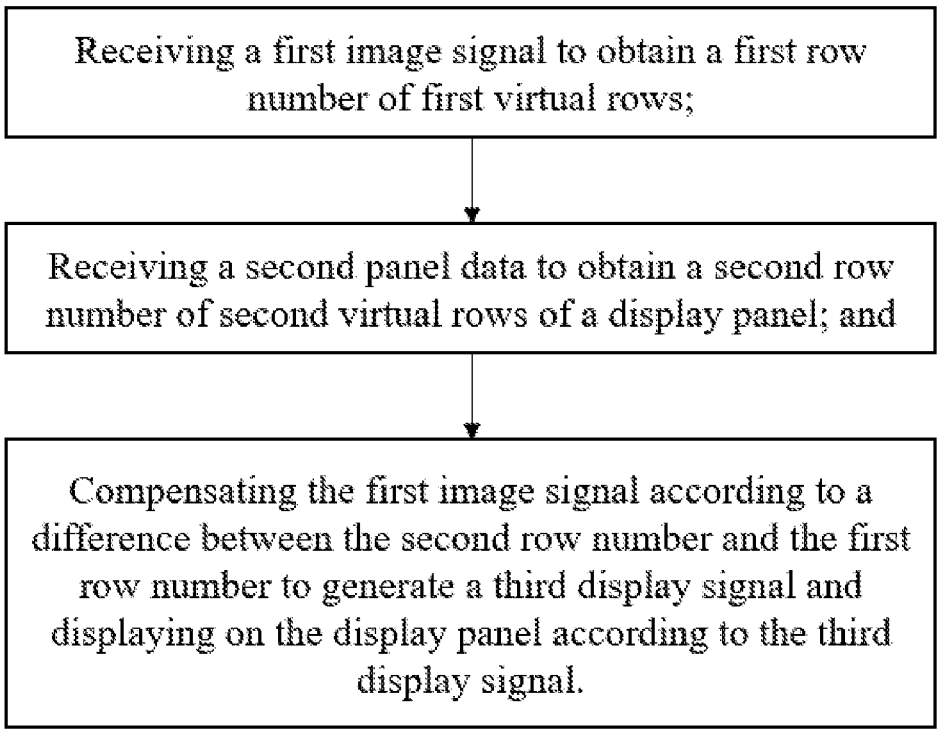
FIG. 4A to FIG. 4B are flowcharts of a display method of a display device provided by an embodiment of the present application.
Figure 4B:
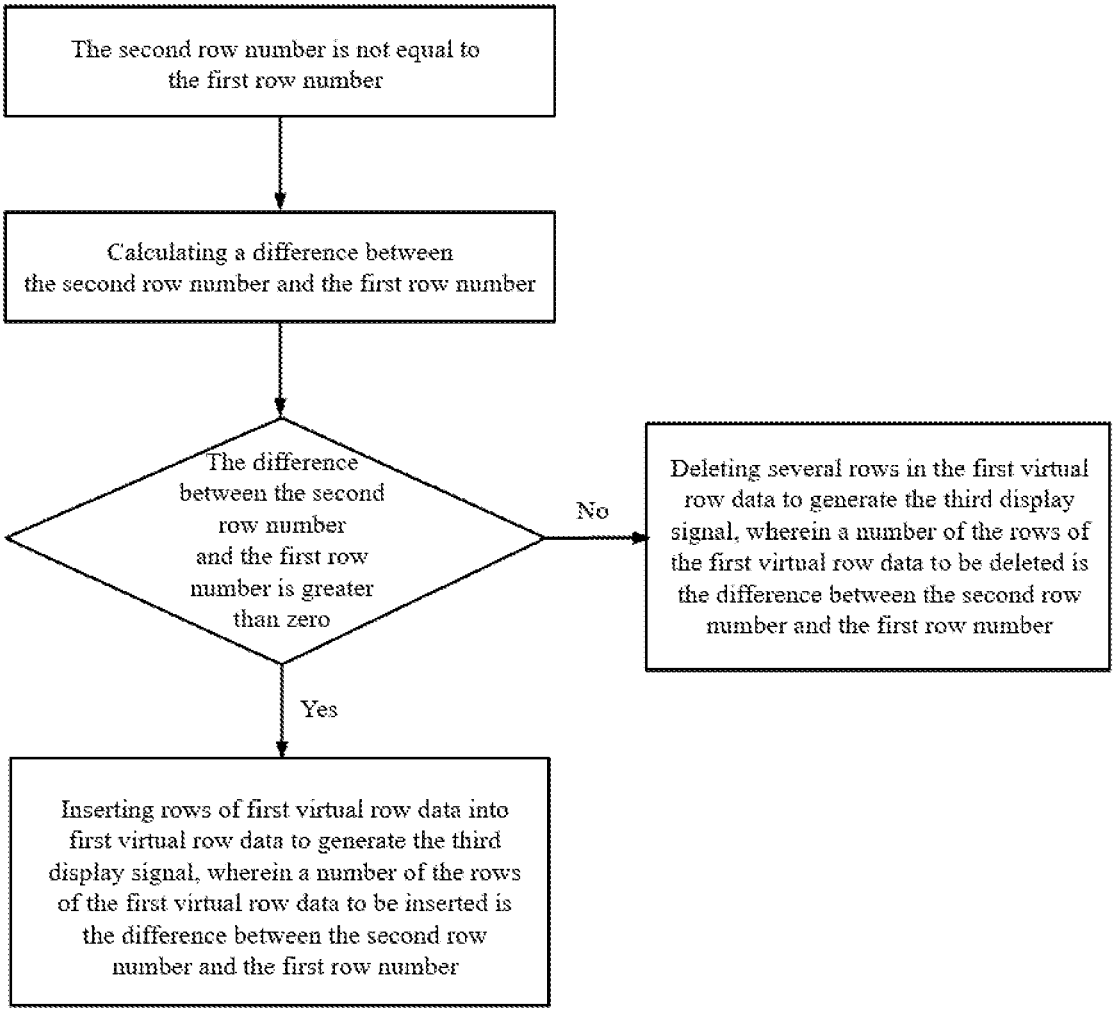

FIG. 4A to FIG. 4B are flowcharts of a display method of a display device provided by an embodiment of the present application. The present application further provides a display method of a display device, the display device includes any of the above-mentioned display devices, and the display method includes following steps: receiving a first image signal to obtain a first row number of first virtual rows; receiving a second panel data to obtain a second row number of second virtual rows of a display panel; and compensating the first image signal according to a difference value between the second row number and the first row number to generate a third display signal, so that the display panel displays according to the third display signal.

Optionally, the step of receiving the first image signal to obtain the first row number of the first virtual rows further includes: receiving the first image signal to obtain the first virtual row data corresponding to the first virtual rows.

Before the step of inserting or deleting the rows of the first virtual row data of the first image signal according to the difference value between the second row number and the first row number to generate the third display signal, the method further includes: comparing the second row number with the first row number.

If the second row number is not equal to the first row number, the difference value between the second row number and the first row number is calculated. Wherein, the difference value between the second row number and the first row number may be greater than zero or less than zero.

If the second row number is equal to the first row number, the first image signal is transmitted to the display panel 100 to display by display panel.

The step of compensating the first image signal according to the difference value between the second row number and the first row number to generate the third display signal includes: inserting or deleting rows of the first virtual row data of the first image signal according to the difference value between the second row number and the first row number to generate the third display signal, wherein a number of the rows of the first virtual row data to be inserted or deleted is the difference value.

The step of inserting or deleting the rows of the first virtual row data of the first image signal according to the difference value between the second row number and the first row number to generate the third display signal further includes: determining whether the difference value between the second row number and the first row number is greater than zero.

If the difference value between the second row number and the first row number is greater than zero, then inserting the first virtual rows into the first image signal, where the number of rows to be inserted is the difference value between the second row number and the first row number. That is, the first virtual row data is inserted into the first virtual row data to generate the third display signal, where the number of rows inserted is the difference value between the second row number and the first row number.

If the difference value between the second row number and the first row number is less than zero, then deleting the first virtual rows in the first image signal, where the number of rows to be deleted is the difference value between the second row number and the first row number. That is, the first virtual row data is deleted in the first virtual row data to generate the third display signal, where the number of rows deleted is the difference value between the second row number and the first row number.

It can be understood that the display device includes a movable display device (such as a notebook computer, a mobile phone, etc.), fixed terminals (such as desktop computers, TVs, etc.), measuring devices (such as sports bracelets, thermometers, etc.), augmented reality display devices, virtual reality display devices, etc.

The principles and implementations of the present application are described herein by specific embodiments, and the descriptions of the embodiments are only used to help understand the methods and core ideas of the present application. Meanwhile, for one skilled in the art, according to the idea of the present application, there will be changes in the specific embodiments and the scope of the present application. In conclusion, the content of this specification should not be construed as a limitation on the present application.

What is claimed is:

1. A display device, comprising:

a display panel;

an image input module configured to provide a first image signal;

a memory configured to store a second panel data; and a display compensation unit comprising a processing chip electrically connected to the display panel, the image input module, and the memory;

wherein the processing chip is configured to receive the first image signal to obtain a first row number of first virtual rows, configured to receive the second panel data to obtain a second row number of second virtual rows of the display panel, and configured to compensate the first image signal according to a difference value between the second row number and the first row number to generate a third display signal, and wherein the third display signal is received by the display panel to display, and wherein the first virtual rows are rows in the first image signal corresponding to first virtual row data, the second virtual rows are rows in the second panel data corresponding to second virtual row data, and the first virtual row data and the second virtual row data are image data that does not participate in image display.

2. The display device of claim 1, wherein the processing chip is further configured to receive the first image signal to obtain the first virtual row data corresponding to the first virtual rows and configured to insert or delete rows of the first virtual row data of the first image signal according to the difference value between the second row number and the first row number to generate the third display signal, wherein a number of the rows of the first virtual row data to be inserted or deleted is the difference value.

3. The display device of claim 1, wherein the processing chip is configured to receive the second panel data to obtain an initial row acting on a display area of the display panel and obtain the second row number of the second virtual rows according to the initial row.

4. The display device of claim 1, wherein the display compensation unit further comprises:

a readback module configured to read the second panel data in the memory and transmit the second panel data to the processing chip.

5. The display device of claim 1, wherein the display compensation unit further comprises:

a storage module configured to store the first image signal output by the image input module and transmit the first image signal to the processing chip.

6. The display device of claim 5, wherein the display compensation unit further comprises:

an image acquisition module configured to receive the first image signal output by the image input module and transmit the first image signal to the storage module.

7. The display device of claim 1, wherein the display compensation unit further comprises:

an image transmission module configured to receive the third display signal from the processing chip and to output the third display signal to the display panel.

8. The display device of claim 1, wherein the image input module comprises a system-on-chip and a timing controller electrically connected to each other, and wherein the display compensation unit is electrically connected between the system-on-chip and the timing controller, or the timing controller is electrically connected between the system-on-chip and the display compensation unit.

9. The display device of claim 8, wherein the system-on-chip comprises a central processing unit and a graphics processing unit, wherein the graphics processing unit is configured to convert an output signal of the central processing unit into frames of the first image signal and output the frames of the first image signal to the display compensation unit and the memory.

10. The display device of claim 8, further comprising a motherboard and a control board, wherein the system-on-chip is disposed on the motherboard, and the timing controller is disposed on the control board.

11. The display device of claim 1, wherein the memory comprises a flash memory.

12. The display device of claim 1, further comprising a horizontal circuit board, wherein the memory is disposed on the horizontal circuit board.

13. The display device of claim 5, wherein the storage module comprises a latch.

14. The display device of claim 7, wherein the image transmission module comprises a data buffer.

15. A display method of a display device, comprising following steps:

receiving a first image signal to obtain a first row number of first virtual rows;

receiving a second panel data to obtain a second row number of second virtual rows of a display panel; and compensating the first image signal according to a difference value between the second row number and the first row number to generate a third display signal and displaying on the display panel according to the third display signal, wherein the first virtual rows are rows in the first image signal corresponding to first virtual row data, the second virtual rows are rows in the second panel data corresponding to second virtual row data, and the first virtual row data and the second virtual row data are image data that does not participate in image display.

16. The display method of claim 15, wherein the step of receiving the first image signal to obtain the first row number of the first virtual rows further comprises:

receiving the first image signal to obtain the first virtual row data corresponding to the first virtual rows; and wherein the step of compensating the first image signal according to the difference value between the second row number and the first row number to generate the third display signal comprises:

inserting or deleting rows of the first virtual row data of the first image signal according to the difference value between the second row number and the first row number to generate the third display signal, wherein a number of the rows of the first virtual row data to be inserted or deleted is the difference value.

17. The display method of claim 16, wherein before the step of inserting or deleting the rows of the first virtual row data of the first image signal according to the difference value between the second row number and the first row number to generate the third display signal, the method further comprises:

comparing the second row number with the first row number.

18. The display method of claim 16, wherein the step of inserting or deleting the rows of the first virtual row data of the first image signal according to the difference value between the second row number and the first row number to generate the third display signal further comprises:

determining whether the difference value between the second row number and the first row number is greater than zero.

19. The display method of claim 18, wherein the difference value between the second row number and the first row number is greater than zero, and the rows of the first virtual row data are inserted to generate the third display signal.

20. The display method of claim 18, wherein the difference value between the second row number and the first row number is less than zero, and the rows of the first virtual row data are deleted to generate the third display signal.

* * * * *